United States Patent [19]

Krein

[11] Patent Number: 4,852,619

[45] Date of Patent: Aug. 1, 1989

[54] SEAT COVER INVERTER

[75] Inventor: Reuben Krein, Fort Smith, Ark.

[73] Assignee: BJK Industries, Inc., Fort Smith, Ark.

[21] Appl. No.: 92,476

[22] Filed: Sep. 3, 1987

[51] Int. Cl.[4] ..... B65B 31/04

[52] U.S. Cl. ..... 141/7; 141/65; 141/114

[58] Field of Search ..... 141/7, 65, 66, 114; 414/758, 763, 786

[56] References Cited

U.S. PATENT DOCUMENTS

| | | | |
|---|---|---|---|
| 3,020,121 | 2/1962 | Bull | 141/66 |
| 3,580,300 | 5/1971 | Dunn, Jr. | 141/65 |
| 4,703,782 | 11/1987 | Henkel, Sr. | 141/65 |

*Primary Examiner*—J. R. Scott

*Attorney, Agent, or Firm*—Ross, Howison, Clapp & Korn

[57] ABSTRACT

A method and apparatus is provided for turning a seat cover inside out. A pressure vessel (12) is fitted with a vacuum pump (16). The pressure vessel (12) is also provided with an inlet (20) which is fitted with a butterfly valve (22). The valve (22) is opened and closed by a pneumatic cylinder (39). Attached to the pressure vessel (12) around the valve (22) is a hood (26). The hood (26) has an open end (30) distal the attached end (28). A seat cover (32) is interfaced with the open end (30) of the hood (26). A vacuum is then created in the pressure vessel (12) and the valve (22) is opened. As the air from inside the seat cover (32) and the hood (26) is sucked into the pressure vessel (12), the seat cover (32) is also drawn into the hood (26). Since the pressure vessel (12) has a known volume of air removed and the hood (26) is of a known volume, the speed and/or amount of the seat cover (32) which is drawn into the hood (26) can be adjusted as desired.

12 Claims, 2 Drawing Sheets

FIG. 3
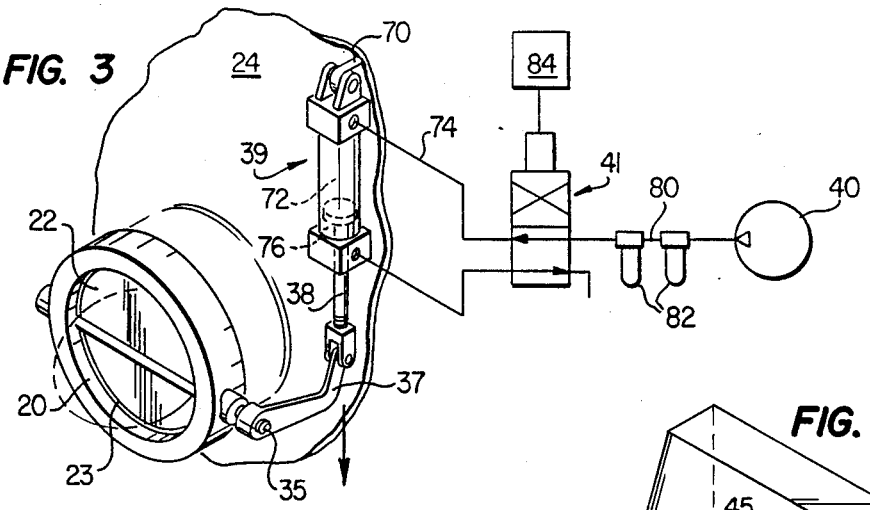
FIG. 2
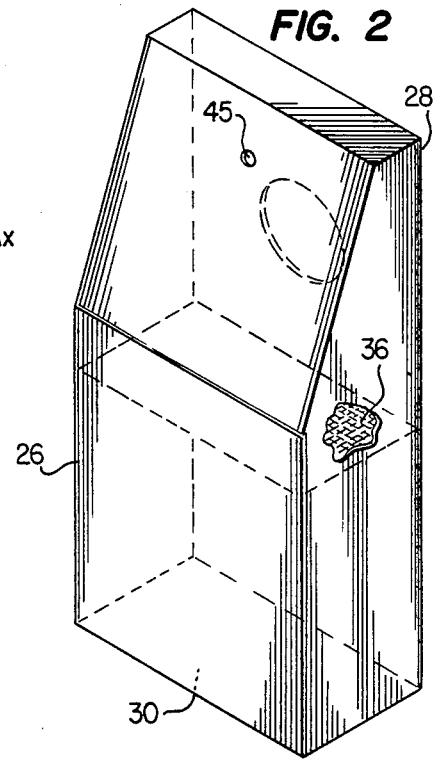
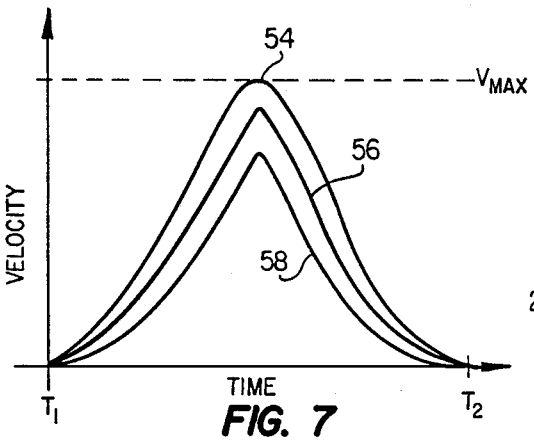
FIG. 7
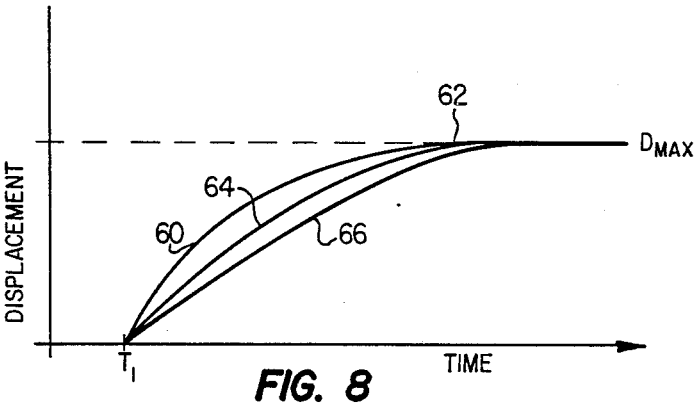
FIG. 8

SEAT COVER INVERTER

TECHNICAL FIELD OF THE INVENTION

This invention pertains in general to seat cover inverters and in particular, to a method and apparatus for inverting a seat cover prior to installation on a frame.

BACKGROUND OF THE INVENTION

It is necessary to turn a seat cover inside out in order to place it over a seat frame or to perform other assembly operations. Since seat covers are manufactured wrong side out, they must be reversed prior to installation. Reversing the seat covers has typically been done as a manual operation in which an individual would reverse the cover entirely by hand. This is a time consuming step that is very labor intensive.

Unsatisfactory apparatus designs have previously been created. These devices generally comprise a hollow tube or shaft over which a seat cover is fitted. At the opposite end of the shaft a blower is installed which draws air from the shaft and sucks the seat cover into the shaft. The primary problem with this apparatus is that there is no satisfactory way to automatically stop the suction when the seat cover reaches its proper position. This often results in torn, ripped or improperly turned seat covers.

Previous apparatus designs have resulted in torn or improperly turned seat covers due to the fact that a constant high velocity is attained. When the device is turned on, it immediately begins to pull on the seat cover until it reaches its maximum velocity and then abruptly stops. The seat cover, therefore, goes from a stationary state to a rapidly moving state and back to a stationary state again. This rapid acceleration followed by an immediate stop is what may cause the seat cover to tear or become damaged. Of course, the weight of the fabric is another factor that is not considered in the previous devices in that the fabric weight determines how the fabric will be affected by the suction.

A need thus exists for a method and apparatus for turning a seat cover inside out without causing damage to the seat cover.

SUMMARY OF THE INVENTION

The present invention disclosed and claimed herein comprises a pressure vessel of a first predetermined volume equipped with an outlet to which a vacuum pump is attached. A butterfly valve is inserted into an inlet on the pressure vessel. Attached around the inlet and the corresponding valve is a hood. Opposite the attachment point to the valve, the hood is a rectangular shaped channel. The channel is open to the atmosphere. When a seat cover is attached to the hood, the volume of air within the hood and the volume of air within the seat cover provide a second predetermined volume which is disposed at atmospheric pressure.

In operation, a vacuum or low pressure is first created within the pressure vessel. When the desired vacuum pressure is attained, the inlet valve is opened causing the air within the hood and the seat cover, the second predetermined volume, to be sucked into the first predetermined volume of the pressure vessel, which is disposed at a low pressure. This suction causes the seat cover to be drawn into the opening of the hood. By varying the vacuum pressure inside the known volume of the pressure vessel, the seat cover reversal can be adjusted to whatever extent is desired.

BRIEF DESCRIPTION OF THE DRAWINGS

For a more complete understanding of the present invention and for further advantages thereof, reference is now made to the following Detailed Description taken in conjunction with the accompanying Drawings in which:

FIG. 2 is a side perspective view of the hood;

FIG. 3 is a front view of the inlet valve and actuating piston with its associated linkage;

FIG. 7 is a velocity versus time diagram; and

FIG. 8 is a displacement versus time diagram.

DETAILED DESCRIPTION OF THE INVENTION

Figure 1:
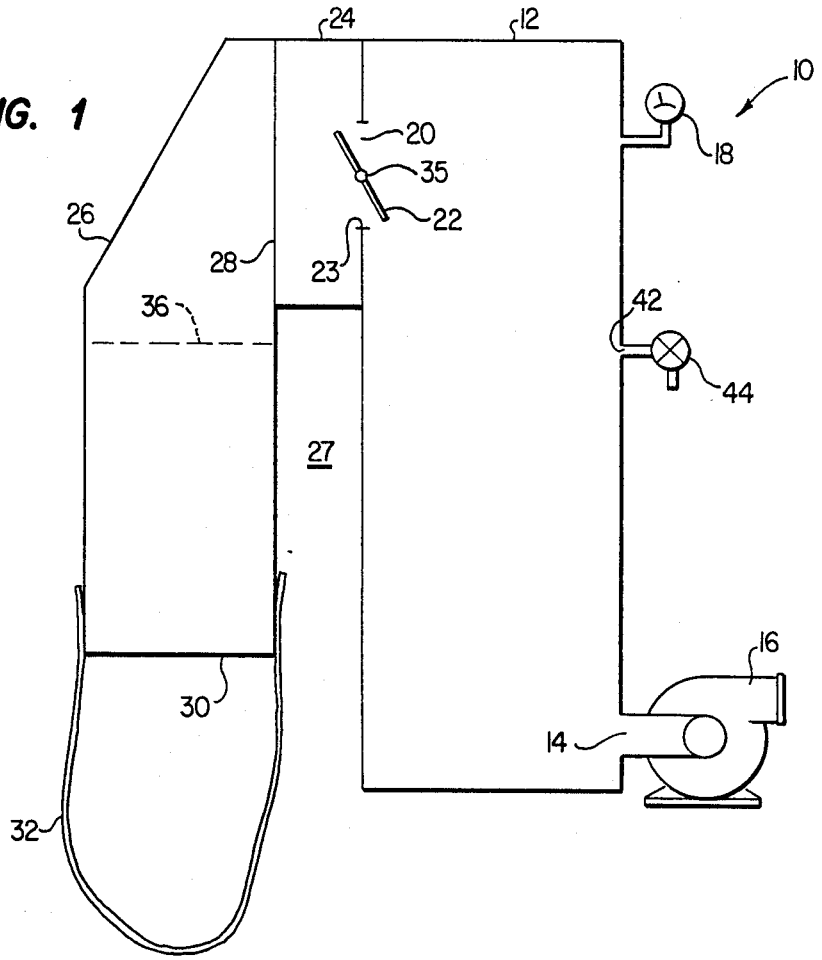
FIG. 1 is a cross-sectional view of the present invention.

Referring now to FIG. 1, an apparatus for turning a seat cover inside out is generally identified by reference numeral 10. A pressure vessel 12 is provided that has a predetermined volume of, for example, 120 cubic feet. The pressure vessel 12 has an outlet 14, which is attached to a vacuum pump 16. Vacuum pump 16 may be, for example, an EG&G Rotron P.N.DRSSK72E/036101. The pressure vessel 12 is preferably equipped with a vacuum gauge 18 for reading various pressures, for example, in millimeters of mercury. The pressure in pressure vessel 12 is a low vacuum, i.e. 7–10 mm Hg, so pressure testing is not required.

The pressure vessel 12 has an inlet 20. Inserted in inlet 20 is a butterfly valve 22, for example a Crane 12" No. 44 Fx2. The valve 22 is operable to rotate about the central axis thereof on a shaft 35 from an open position to a closed position in a "butterfly" operation. A seal 23 is provided around the valve 22 to ensure an airtight connection. The seal 23 may be made of any suitable material, for example, rubber. The valve 22 may be positioned to open or close the inlet 20.

Fixed to the pressure vessel 12 is an attachment device 24. The attachment device 24 is constructed and arranged around the inlet 20 so as to allow attachment of a hood 26. The attachment device 24 extends from the pressure vessel 12 forming a gap 27 between hood 26 and the pressure vessel 12. The gap 27 is provided to allow for attachment of a seat cover 32 onto the hood 26 and also to provide a predetermined volume of air.

Referring simultaneously to FIGS. 1 and 2, the hood 26 can be seen to have a first end 28 and an open end 30. The hood 26 is designed so as to resemble a rectangular shaped channel resulting in the open end 30. The hood 26 is constructed, for example, of commercial grade steel and is welded together. It is to be understood that the hood 26 could be fabricated from other materials, for example, aluminum, and could be bolted and sealed together. The hood 26 is fixed to the attachment device 24 at the first end 28 in sealing engagement therewith to allow the interior of the pressure vessel 12 to communicate with the interior of the hood 26.

The seat cover 32 is operable to be attached to the hood 26 at the open end 30 of the hood 26 by slipping the open end of the seat cover 32 over the open end 30 of the hood 26. There are marks provided on the side of hood 26 to provide a reference for the operator as to how far up the hood 28 to slip the seat cover 32. This is a trial and error operation to obtain the proper seat cover inversion. A screen 36 is fixedly attached inside the hood 26 at a predetermined distance from the open end 30 of the hood 26 so as to prevent unwanted objects from entering the pressure vessel 12 through the valve 22. The seat cover 32 when attached to hood 26 provides a sealed volume which is in communication with pressure vessel 12 through inlet 20 and valve 22. This sealed volume has a predetermined volume of approximately, for example, three cubic feet that is disposed at atmospheric pressure.

FIG. 3 illustrates a detailed view of the valve 22 that allows communication between the hood 26 and the pressure vessel 12. Attached to the valve 22 by valve shaft 35 is an arm 36 which is attached to the end of shaft 35 at a point offset from the longitudinal axis thereof to allow for rotating motion. The arm 37 is activated to rotate shaft 35 by a piston 38 of a pneumatic cylinder 39 which can be, for example an ARO P.N. 1920-1011-1-040.

The pneumatic cylinder 39 is secured to the attachment device 24 by a detachable clevis 70. The pneumatic cylinder 39 is of the double acting type. When air is provided to a top chamber 72 through an air line 74, piston 38 is extended as shown in FIG. 3. When air is provided to a lower chamber 76 through an air line 78, piston 38 is retracted (not shown). Pneumatic cylinder 39 thus provides positive drive of the piston 38 in both directions.

Air is provided to the cylinder 39 by a compressor 40 through a four-way directional valve 41. Directional valve 41 may be, for example, a Speedair ½" P.N.1A214. The Compressor 40 sends air to the directional valve 41 via air line 80. Before reaching the directional valve 41 it may be desirable to filter the air. This filtering can be accomplished by installing air filters 82 in the line 80. The air filters 82 may be, for example, Speedair P.N.72558.

To activate the directional valve 41 and thus the piston 38, a switch 84 is connected to the directional valve 41. The switch 84 may be of any appropriate design and may be a foot controlled switch such as a Linemaster P.N.6323. The valve 22 is opened when the directional valve 41 sends air into the top chamber 72 of the cylinder 39. The air forces the piston 38 to extend as shown in FIG. 3) which in turn causes the arm 37 to turn the valve 22 into its open position. The valve 22 is closed by reversing this process. The directional valve 41 sends air to the lower chamber 76 of the cylinder 39. The air forces the piston 38 to retract (not shown) which in turn causes the arm 37 to turn the valve 22 to its closed position.

In the preferred embodiment, the pressure vessel 12 has an additional inlet 42. Attached to inlet 42 is a bleed valve 44, for example, a Gast model AG258A. The bleed valve 44 may be adjusted to allow air to enter the pressure vessel 12 to modify the vacuum pressure as may be required for operation of the apparatus 10. By adjusting the bleed valve 44, the pressure inside pressure vessel 12 can be varied. By closing the bleed valve 44 the pressure inside the pressure vessel 12 will be allowed to reach the maximum capacity of the vacuum pump 16, whereas opening of the bleed valve 44 increases the pressure.

Alternatively, an orifice 45 may be provided on the hood 26 opposite the valve 22. As will be described hereinbelow, the orifice 45 serves basically the same purpose as the bleed valve 44. By providing orifice 45, air will be drawn from another external source and, therefore, change the speed of the air exchange from the hood 26 and the seat cover 32 to the pressure vessel 12. If the orifice 45 is used, a filter or screen must also be supplied to prevent unwanted particles from entering the pressure vessel 12.

Figure 4:
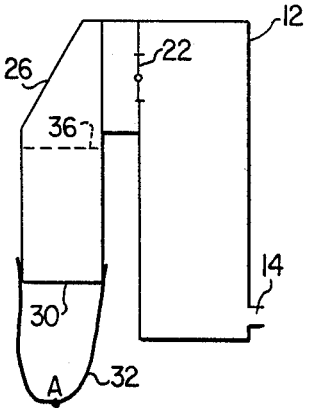
FIGS. 4–6 are cross-sectional views of the present invention in various stages of operation.
Figure 5:
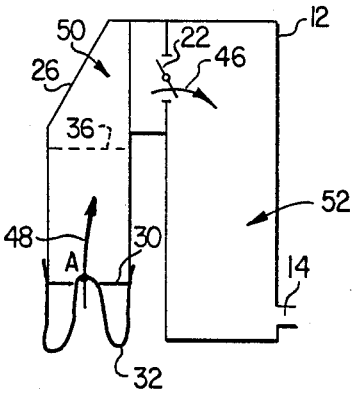
Figure 6:
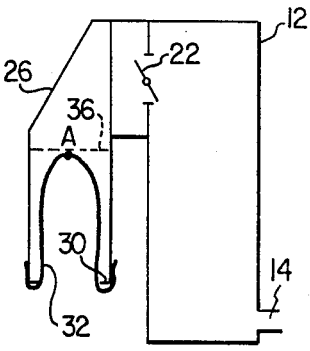

The operation of apparatus 10 can best be described by viewing the various stages of operation of FIGS. 4, 5, and 6. In FIG. 4 seat cover 32 is fixed to the open end 30 of the hood 26 by the holding devices 34. The directional valve 41 is positioned so as to retract the piston 38 of the pneumatic cylinder 39. By retracting the piston 38, the valve 22 is placed in its closed position.

A vacuum is created in the pressure vessel 12 by activating the vacuum pump 16. If a bleed valve 44 is provided, it may be opened or closed to adjust the amount of vacuum pressure inside the pressure vessel 12 and, therefore, the pressure difference between the interior of hood 26 and the interior of pressure vessel 12. If the hood 26 is provided with an orifice 45, no further adjustments to the pressure within the pressure vessel 12 is required.

In FIG. 4, by way of illustration, seat cover 32 can be seen to have a Point A located at the bottom of the attached seat cover 32. In FIG. 4, seat cover 32 is seen to be in its preparatory position, i.e. hanging from the holding devices 34 in the right side out condition as it comes from the manufacturer. Point A represents an imaginary point on the bottom center of the seat cover in this right side out condition. It should be noted that the position and size of seat cover 32 in conjunction with the volume of hood 26 determines the defined volume that is in communication with pressure vessel 12.

FIG. 5 represents an intermediate stage of the operation of the apparatus 10. In FIG. 5 the directional valve 41 has been positioned so as to force air into the top end of the cylinder 39 thus moving the piston 38 to its extended position. In its extended position, piston 38 causes the arm 37 to turn the valve 22 into its open position. As the valve 22 is opened, the known volume of air within the hood 26 and the seat cover 32 is sucked into the pressure vessel 12 as shown by arrow 46. The speed at which Point A and thus the seat cover 32 is drawn into the hood 26 depends on the combined volume of air within both the hood 26 and the seat cover 32. Other factors that affect the speed of Point A will include the permeability of the material of seat cover 32 (for example, open weave cloth versus vinyl), the pressure within the pressure vessel 12, and whether an orifice 45 is provided.

As shown in FIG. 5, Point A on the seat cover 32 is now drawn partially within the hood 26 as shown by an arrow 48. As indicated above, air may also enter through orifice 45 as shown by an arrow 50 or through the bleed valve 44 as indicated by an arrow 52. In this position, the combined volume of the seat cover 32 and hood 26 decreases and the pressure within pressure vessel 12 increases. This effectively reduces the pulling force on Point A and, thus, the acceleration.

FIG. 6 illustrates the final position of the seat cover 32 in its fully inverted position. Point A of the seat cover 32 is now drawn fully into the hood 26. It is preferable to adjust the velocity of Point A so as to reach a maximum and then decrease slowly prior to reaching the position as shown in FIG. 6. It is an advantage of the present invention to be able to provide this adjustment. Adjustments are made by modifying the pressure of the pressure vessel 12, the volume of the hood 26 in conjunction with the volume of the seat cover 32 and/or the use of a bleed valve 44 or an orifice 45.

FIG. 7 is a graphic illustration of the velocity of Point A as a function of time. Velocity is depicted on the vertical axis while time is depicted on the horizontal axis. At time T1, the velocity is shown to be zero. When the valve 22 is placed in its open position, the velocity of Point A rapidly approaches its maximum, VMAX, at a point 54. After Point A reaches VMAX at point 54, the velocity gradually drops off until it reaches zero again. A return to zero velocity at $T_3$ corresponds to the final inverted position as shown in FIG. 6. The seat cushion ceases movement at this point. However, if the evacuated volumes between the pressure vessel 12 and the combined volume of the seat cover 32 and hood 26 were not correctly adjusted, the final position could be reached prior to the velocity being equal to zero. With the present invention, this is not detrimental as the velocity of Point A is significantly reduced, therefore preventing damage to the seat cover when it reaches its maximum inversion point.

Lines 56 and 58 of FIG. 7 depict graphically velocity as a function of time for various adjustments to apparatus 10. For example, the line 56 may represent the effect of opening a bleed valve 44 when pulling a vacuum on pressure vessel 12, resulting in a higher pressure internal thereto. Line 58 may represent, for example, the effect of utilizing an orifice 45. The orifice 45 provides an alternate path by which air is input to pressure vessel 12 during inversion of seat cover 32. Orifice 45 effectively enlarges hood 26. A similar effect will be noticed where seat cover 32 is fabricated from a porous material. The use of a feed valve 44 or an orifice 45 can thus be seen to lower the maximum velocity of Point A.

FIG. 8 graphically displays the effect of displacement of Point A over time. Displacement is depicted on the vertical axis while time is displayed on the horizontal axis. As shown, T1 represents the position of seat cover 32 at its original right side out condition as shown in FIG. 4. As butterfly valve 22 is placed in its open position, Point A of seat cover 32 begins to be drawn into the hood 26 as shown by an arrow 48 on FIG. 5. The position of Point A of the seat cover 32 in FIG. 5 is illustrated at point 60 in FIG. 8. The point 62 represents the fully displaced position of Point A on seat cover 32 as shown in FIG. 6. Lines 64 and 66 of FIG. 8 graphically display the effects of varying some of the factors as discussed above, i.e. the combined volume of the hood 26 and the seat cover 32, the evacuated volume of the pressure vessel 12, or use of a bleed valve 44 or an orifice 45. The line 64, for example, may represent the use of a bleed valve 44. As can be seen, the use of a bleed valve 44 slows down the displacement of Point A over time, but Point A still reaches a maximum displacement DMAX. Also as seen by the line 66, which may represent the use of an orifice 45, the maximum displacement can be slowed down over time.

The maximum displacement of Point A is reached when one of two situations occurs. First, when the pressure of pressure vessel 12 reaches atmospheric pressure, Point A will have no positive force thereon other than inertia. This will effectively stop movement or inversion at this point. Second, when the seat cover 32 reaches maximum extension, Point A will come to an abrupt halt, but the velocity at this point will be relatively low, thus minimizing, if not eliminating, the possibility of damage. With proper adjustment of the bleed valve 44 or orifice 45, the velocity of Point A will be zero when the desired inversion is reached.

In summary, the present invention provides an improved method and apparatus for turning a seat cover inside out. By using two preset volumes, a first low pressure in a pressure vessel and a second higher pressure in a hood that is in communication with the pressure vessel through a valve, a seat cover may be turned inside out without danger of tearing or improperly turning the cover. This is an advantage over other previous apparatus in that the velocity of the seat cover is allowed to reach a maximum and then slowly decrease prior to the seat cover reaching its fully inverted position. Prior apparatus would rapidly accelerate until it reached its maximum displacement and then stop abruptly. This resulted in tears or other damage to the seat cover.

Although the present invention has been described with respect to a specific preferred embodiment thereof, various changes and modifications may be suggested to one skilled in the art and it is intended that the present invention encompass such changes and modifications as fall within the scope of the appended claims.

What is claimed is:

1. An apparatus for turning a seat cover inside out, the seat cover having an internal volume and at least one open end, comprising:

a pressure vessel of a first predetermined volume;

means for creating a vacuum inside pressure vessel;

a hood having a first end attached to said pressure vessel and an open end distal to said first end;

said hood having an interior space with a defined volume;

inhibit means for inhibiting air flow through said opening, said means for inhibiting having an open position and a closed position;

an opening disposed between the interior space of said hood and the anterior of said pressure vessel;

select means for selecting said open position or said closed position of said inhibit means;

the seat cover having peripheral edges on the open end thereof; and means for attaching the seat cover at the peripheral edges of the unsealed end thereof to said open end of said hood to seal the open end of said hood and define a second predetermined volume at a higher pressure than said pressure vessel, whereby selecting the open position of said inhibit means by said select means in air being sucked through said opening from the interior space of said hood and the seat cover into the pressure vessel to raise the pressure within said pressure vessel, thus drawing the seat cover into the interior space of the hood and turning the seat cover inside out.

2. The apparatus for turning a seat cover inside out of claim 1, wherein said pressure vessel has an additional inlet for attachment of a bleed valve for adjusting the level of the vacuum in said pressure vessel.

3. The apparatus for turning a seat cover inside out of claim 1, wherein said hood is provided with an orifice for adjusting air flow from the outside of said hood to the interior thereof.

4. The apparatus for turning a seat cover inside out of claim 1, wherein said opening comprises a generally circular inlet to said pressure vessel; and , said inhibit means comprises:

a rotatable valve inserted in said inlet;

said valve having a central axis with a shaft attached thereon;

said shaft being operable to rotate said rotatable valve to said open position and said closed position, said select means operable to control said shaft.

5. The apparatus for turning a seat cover inside out of claim 4, wherein said select means comprises:

an arm having a first and second end;

said arm attached at said first end to the shaft operable about the central axis of the rotatable valve;

said arm attached at said second end to a piston of a pneumatic cylinder; and said pneumatic cylinder powered by an attached air compressor, whereby the air compressor is activated to move the piston of the pneumatic cylinder and in turn move the arm causing the rotatable valve to open or close.

6. An apparatus for turning a seat cover inside out comprising:

a pressure vessel of a first predetermined volume;

means for creating a vacuum inside said pressure vessel;

a hood having a first end attached to said pressure vessel and an open end distal to said first end;

said hood having a defined volume;

generally circular inlet to said pressure vessel communicating between the attached end of the hood and said pressure vessel;

a rotatable valve having an open and a closed position inserted in said inlet;

said rotatable valve having a central axis with a shaft superimposed thereon;

said shaft being operable to rotate said rotatable valve;

an arm having a first and second end;

said arm attached at said first end to said shaft;

said arm attached at said second end to a piston of a pneumatic cylinder;

said pneumatic cylinder powered by an attached air compressor and controlled by a directional valve, such that the directional valve is activated to move the piston of the pneumatic cylinder and in turn move the arm;

said movement of said arm causing the shaft to rotate the valve to its open or closed position;

said seat cover having an unsealed end with peripheral edges; and means for interfacing the seat cover at the peripheral edges of the unsealed end thereof to said open end of said hood to seal the open end of said hood and define a second predetermined volume at a higher pressure that said pressure vessel, whereby opening of said rotatable valve results in air being sucked through the rotatable valve from the hood and the seat cover into the pressure vessel to raise the pressure within said pressure vessel, thus drawing the seat cover into the hood and turning the seat cover inside out.

7. The apparatus for turning a seat cover inside out of claim 6, wherein said pressure vessel has an additional inlet for attachment of a bleed valve.

8. The apparatus for turning a seat cover inside out of claim 6, wherein said hood is provided with an orifice for adjusting air flow.

9. A method of turning a seat cover inside out, the seat cover having an interior space and at least one open end, comprising:

providing a pressure vessel having opening on the surface thereof;

providing a hood having an interior space, an open end and an attachment end;

attaching the peripheral edges of the open end of the seat cover to an open end of the hood;

the attachment end of the hood attached to the pressure vessel over the opening on the surface thereof;

removing the seal from the opening;

creating a vacuum in said pressure vessel to create a lower pressure in the interior of the pressure vessel relative to the interior of the hood; and the step of removing the seal allowing air to pass between the hood and the pressure vessel such that the seat cover is sucked into the open end of the hood as air from inside the hood and the seat cover is transferred to the vacuum in the pressure vessel.

10. An apparatus for inverting a seat cover having an interior space and at least one open end, comprising:

a first chamber having an open end for receiving the open end of the seat cover;

means for interfacing the peripheral edges of the seat cover at the open end thereof to the open end of said first chamber to form a seal therewith, the seat cover and said first chamber forming a first sealed enclosure, said first sealed enclosure having a maximum volume with the seat cover noninverted and a minimum volume with the seat cover inverted;

a second chamber having a predetermined volume to form a second sealed enclosure;

said second chamber operable to be disposed at a first predetermined pressure lower than atmospheric pressure, and said first sealed enclosure operable to be disposed at atmospheric pressure;

a vacuum pump for disposing said second chamber at said first predetermined pressure at a first time;

connecting means for selectively connecting the interior of said first sealed enclosure with the interior of said second sealed enclosure at a second time after said first time to transfer air from said first sealed enclosure to said second sealed enclosure such that said second sealed enclosure changes from the maximum volume to the minimum volume coincident with the pressure in said second sealed enclosure increasing from the first predetermined pressure to atmospheric pressure.

11. The apparatus of claim 10 and further comprising a bleed valve disposed between the exterior of said second sealed enclosure and the interior thereof to adjust said first predetermined pressure within said second sealed enclosure during said first time.

12. The apparatus of claim 10 and further comprising orifice means for communicating between the interior of said first sealed enclosure and the exterior thereof to allow a predetermined and restricted flow of air to pass therebetween, said orifice means adjusting the minimum volume of said first sealed enclosure.

* * * * *

UNITED STATES PATENT AND TRADEMARK OFFICE

CERTIFICATE OF CORRECTION

PATENT NO. : 4,852,619

DATED : August 1, 1989

INVENTOR(S) : Reuben Krein

It is certified that error appears in the above-identified patent and that said Letters Patent is hereby corrected as shown below:

Column 3, line 47, after "3", delete ")" and insert --,--.

Column 5, line 36, delete "feed" and insert therefore "bleed".

Column 7, line 28, before "generally" insert "a".

Signed and Sealed this

Fourteenth Day of July, 1992

*Attest:*

DOUGLAS B. COMER

*Attesting Officer*

*Acting Commissioner of Patents and Trademarks*